US010926154B2

(12) United States Patent
Messina et al.

(10) Patent No.: US 10,926,154 B2
(45) Date of Patent: Feb. 23, 2021

(54) ICE HOCKEY GOAL POST PEG

(71) Applicants: Joseph John Messina, Grand Rapids, MI (US); Stanley Joseph Matwijiw, South Lyon, MI (US)

(72) Inventors: Joseph John Messina, Grand Rapids, MI (US); Stanley Joseph Matwijiw, South Lyon, MI (US)

(73) Assignee: Piranha Peg LLC, Grand Rapids, MI (US)

( * ) Notice: Subject to any disclaimer, the term of this patent is extended or adjusted under 35 U.S.C. 154(b) by 0 days.

(21) Appl. No.: 16/031,453

(22) Filed: Jul. 10, 2018

(65) Prior Publication Data

US 2019/0009162 A1 Jan. 10, 2019

Related U.S. Application Data

(60) Provisional application No. 62/530,549, filed on Jul. 10, 2017.

(51) Int. Cl.

| | |
|---|---|
| ***A63B 71/02*** | (2006.01) |
| ***A63B 63/00*** | (2006.01) |
| ***A63B 102/24*** | (2015.01) |

(52) U.S. Cl.

CPC ..... *A63B 71/023* (2013.01); *A63B 63/004* (2013.01); *A63B 2071/024* (2013.01); *A63B 2102/24* (2015.10)

(58) Field of Classification Search

CPC ..... A63B 63/04; A63B 71/028

USPC ..... 273/398–402; 473/471, 478

See application file for complete search history.

(56) References Cited

U.S. PATENT DOCUMENTS

| | | | | |
|---|---|---|---|---|
| 3,328,928 | A * | 7/1967 | Frye | A63B 71/023 473/492 |
| 3,979,120 | A * | 9/1976 | Dietrich | A63B 63/004 473/478 |
| 4,619,456 | A * | 10/1986 | Meggs | A63B 63/004 335/296 |
| 5,039,100 | A * | 8/1991 | Cortese | A63B 61/02 273/127 B |
| 5,553,863 | A * | 9/1996 | Wynne | A63B 63/004 273/127 B |
| 5,820,497 | A * | 10/1998 | Pena | 473/471 |
| 2015/0321069 | A1* | 11/2015 | Rogers | A63B 63/004 29/525.08 |
| 2017/0165556 | A1* | 6/2017 | Corbett | A63B 71/028 |

OTHER PUBLICATIONS https://www.hockeyvancouver.ca/products/hockey-net-steel-ice-pegs , printed Nov. 13, 2018.

https://www.sport.qc.ca/en/shop/categories/sports/hockey/goal-anchor-pegs , printed Nov. 13, 2018.

(Continued)

*Primary Examiner* — Jeffrey S Vanderveen

(74) *Attorney, Agent, or Firm* — Dinsmore & Shohl LLP

(57) ABSTRACT

An ice hockey goal post peg includes a molded rubber body extending longitudinally from a top post surface to a bottom ice surface. A post plate is disposed within the rubber body. At least one stud is attached to the post plate. The at least one stud extends beyond the bottom ice surface in a direction toward an ice surface when the goal post peg is installed.

8 Claims, 4 Drawing Sheets

(56) References Cited

OTHER PUBLICATIONS http://hiprosports.net/wp-content/uploads/2014/02/EasyPegs-Large.png , printed Nov. 13, 2018.
http://www.omnisport.ca/wp-content/uploads/2013/07/Omni-Sports-Catalogue-2013-v3.pdf , printed Nov. 13, 2018.
http://www.rinksystems.com/products/accessories/goal-frames-pads-netting.html , printed Nov. 13, 2018.

* cited by examiner

ICE HOCKEY GOAL POST PEG

CROSS-REFERENCE TO RELATED APPLICATIONS

This application claims priority of U.S. Provisional Patent Application Ser. No. 62/530,549, filed Jul. 10, 2017, the entire contents of which are incorporated herein by reference.

FIELD OF THE INVENTION

The invention relates to pegs for securing an ice hockey net to an ice surface.

BACKGROUND OF THE INVENTION

Typically, hockey goals include a pair of posts and a cross bar joining the posts which are formed from hollow pipes. The hockey net may be secured to an ice surface to prevent unwanted movement of the net during play resulting in a stoppage of play to reposition the net. A permanent securing of the net to the ice surface is not desirable as a collision of a player with the net may cause injury to a player. Therefore, it is desirable to temporarily secure a hockey net to an ice surface.

Various peg and securing structures have been utilized to secure a net to the ice surface. For example prior art designs may include a structure that is secured to a subfloor of an ice surface and includes a flexible portion above the ice surface to allow the net to break away. Such designs are very costly to implement and require constant maintenance.

Other designs may include a solid metal peg that is received in the post and includes a single stud placed in an ice surface. However, such designs do not adequately secure the net to the ice surface. Additional designs may include structures having two studs secured to an ice surface. Such designs are often complicated and expensive and require correct positioning of the studs to allow the net to break away correctly.

There is therefore a need in the art for a cost effective structure to secure a hockey net to an ice surface under normal play conditions including normal contact with a goal tender during play but also break away from the ice surface or dislodge from the post upon a significant collision.

SUMMARY OF THE INVENTION

In one aspect, there is disclosed an ice hockey goal post peg including a molded rubber body extending longitudinally from a top post surface to a bottom ice surface. A post plate is disposed within the rubber body. At least one stud is attached to the post plate. The at least one stud extends beyond the bottom ice surface in a direction toward an ice surface when the goal post peg is installed.

In another aspect, there is disclosed an ice hockey goal post peg including a molded rubber body extending longitudinally from a top post surface to a bottom ice surface. A post plate is disposed within the rubber body. At least one stud is attached to the post plate. The at least one stud extends beyond the bottom ice surface in a direction toward an ice surface when the goal post peg is installed. The molded rubber body includes a lower cylinder having a diameter less than a diameter of a goal post opening. The lower cylinder is connected to an upper cylinder by a transition. The upper cylinder has a diameter less than the lower cylinder.

In a further aspect, there is disclosed an ice hockey goal post peg including a molded rubber body extending longitudinally from a top post surface to a bottom ice surface. A post plate is disposed within the rubber body. At least one stud is attached to the post plate. The at least one stud extends beyond the bottom ice surface in a direction toward an ice surface when the goal post peg is installed. The molded rubber body includes a tapered cylinder that narrows in a direction from the bottom ice surface to the top post surface.

DETAILED DESCRIPTION OF THE PREFERRED EMBODIMENTS

Figure 6:
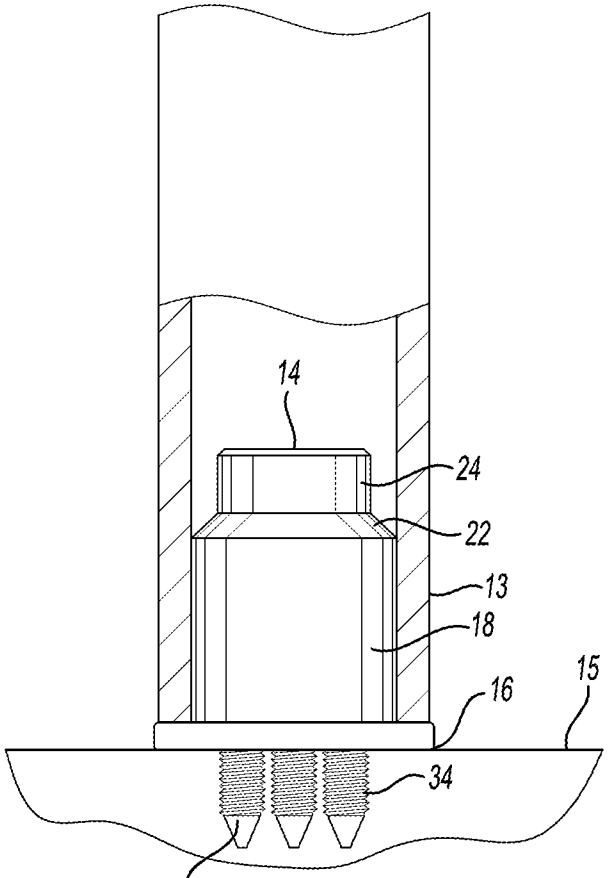
FIG. 6 is a partial view of the goal post, peg and ice surface with the peg in a seated position.

Referring to FIGS. 1-5 there is shown a goal post peg 10. The goal post peg 10 may be used in pairs and are inserted into an opening 11 formed in a bottom of a goal post 13 of an ice hockey net to releasably secure the hockey net to an ice surface 15, as best shown in FIG. 6.

Figure 1:
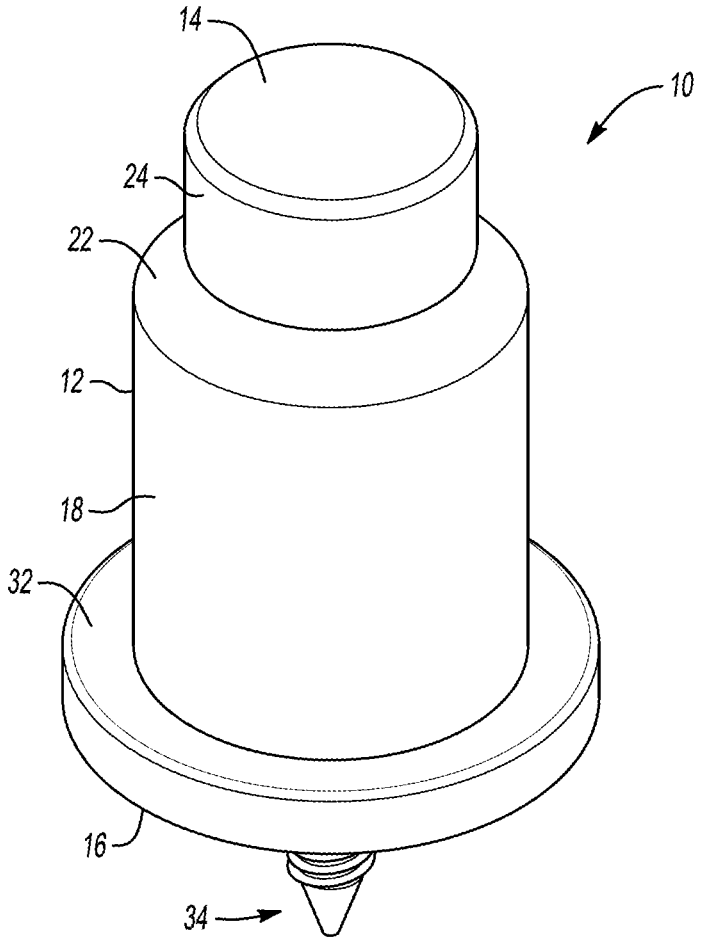
FIG. 1 is a perspective view of a goal post peg.
Figure 2:
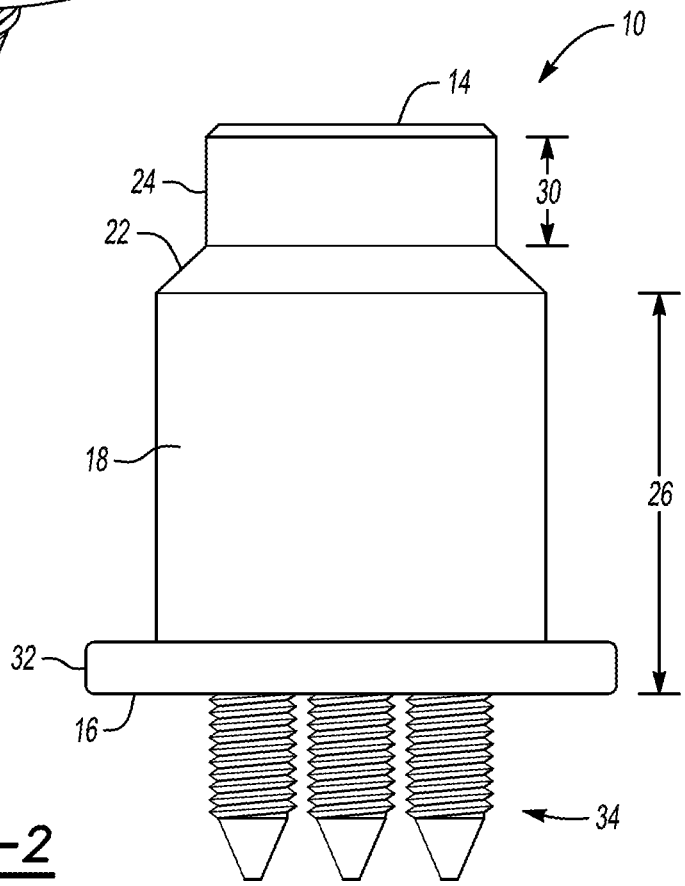
FIG. 2 is a side view of a goal post peg.
Figure 3:
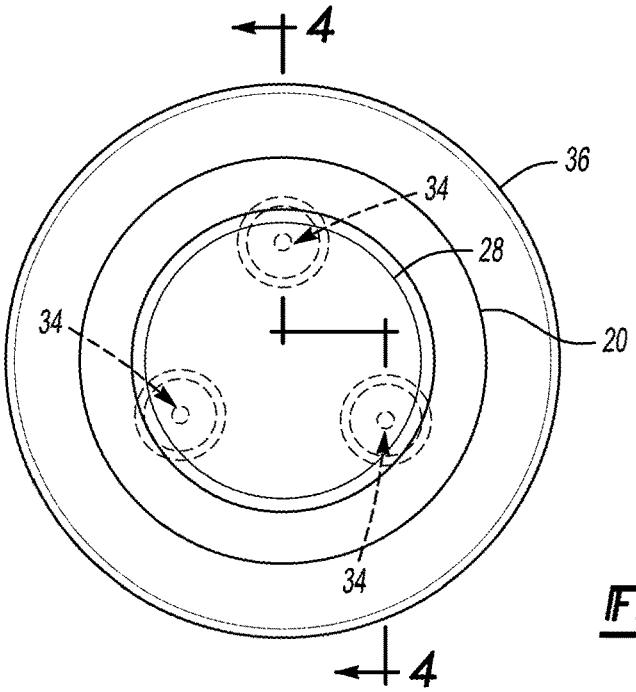
FIG. 3 is a bottom end view of a goal post peg.
Figure 4:
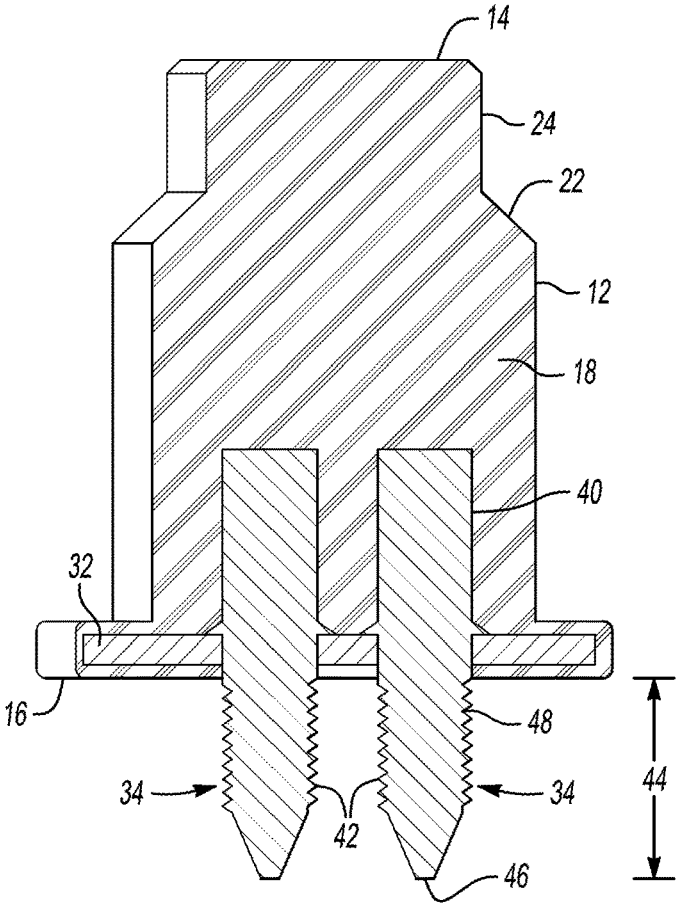
FIG. 4 is a section view of the goal post peg taken along the line A-A of FIG. 3.
Figure 5:
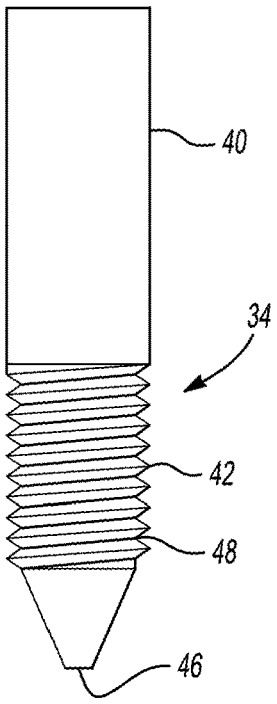
FIG. 5 is a side view of a stud of the goal post peg.

Referring to FIGS. 1, 2 and 4, the goal post peg 10 includes a body 12 that extends longitudinally from a top post surface 14 to a bottom ice surface 16. The body 12 may be formed of a rubber material such as Styrene-butadiene (SBR) rubber having a durometer of 85 that is molded to a specified shape. In one aspect, the rubber material may provide an abrasion resistant material that will withstand wear over repeated use. Additionally, the rubber material may act as an insulating material to prevent transfer of heat from the goal post peg 10 to the ice surface 15. In one aspect, prior art metal pegs may act as conductors and locally melt the ice surface. In such a situation there may not be a reliable release of the net on a major contact and removal of the metal pegs may damage the ice surface and cause large chunks of ice to be removed from the ice surface.

The body 12 includes a lower cylinder 18 that includes a diameter 20 that is less than a size of the opening 11 formed in the goal post 13 of the hockey net. In one aspect, the diameter 20 of the lower cylinder 18 may be approximately 1.87 inches. It should be realized that the dimension provided maybe considered as exemplary and may have variations above or below the exemplary dimension. The body 12 may also include a transition 22 that separates the lower cylinder 18 from an upper cylinder 24. The transition 22 may be a chamfer that couples the lower and upper cylinders 18, 24. The chamfer may have a height of approximately 0.25 inches. It should be realized that the dimension provided maybe considered as exemplary and may have variations above or below the exemplary dimension. The transition 22 may guide the goal post 13 off of the goal post peg 10 during a collision as will be described in more detail below.

The lower cylinder 18 may include a height 26, as measured from the bottom ice surface 16 to the transition 22 of approximately 1.95 inches. It should be realized that the dimension provided maybe considered as exemplary and may have variations above or below the exemplary dimension.

The upper cylinder 24 may include a diameter 28 that is less than the diameter 20 of the lower cylinder 18. In one aspect, the diameter 28 of the upper cylinder 24 may be approximately 1.38 inches. The upper cylinder 24 may include a height 30 as measured from the transition 22 to the top post surface 14 of approximately 0.55 inches. It should be realized that the dimension provided maybe considered as exemplary and may have variations above or below the exemplary dimension.

A post plate 32 is attached to the body 12. The post plate 32 may include ¼ inch thick steel plate that receives ice studs 34 that are positioned in the ice surface 15 when in use. The post plate 32 may be within the body 12 and may be over-molded with the rubber of the body 12. The post plate 32 may include a diameter 36 that is greater than the opening in the goal post. In one aspect, the diameter 36 of the post plate 32 may be approximately 2.50 inches. It should be realized that the dimension provided maybe considered as exemplary and may have variations above or below the exemplary dimension.

Figure 7:
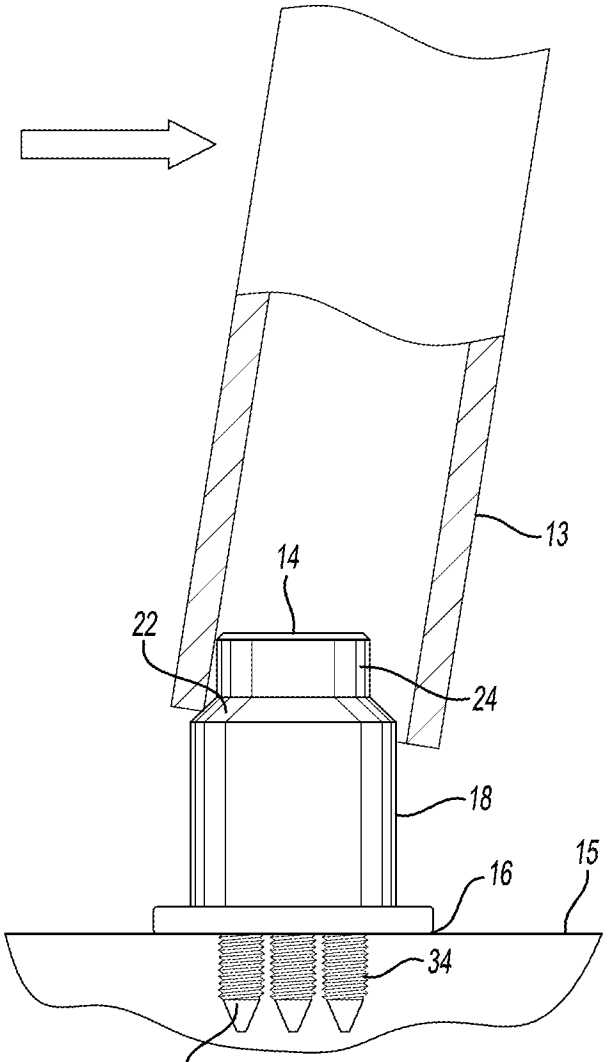
FIG. 7 is a partial view of the goal post, peg and ice surface with the peg in a break away position.

The body includes an overall height 38 that is selected to retain the goal post 13 on the post peg 10 and prevent the net from being dislodged by minor contact with a player such as a goalie. In one aspect the overall height 38 as measured from the top post surface 14 to the bottom ice surface 16 is approximately 2.75 inches. It should be realized that the dimension provided maybe considered as exemplary and may have variations above or below the exemplary dimension. The overall height 38 as specified may be tall enough for goalie strength and stability while moving into and on the post and short enough for breakaway purposes if heavy contact is made with the post during play. The transition 22 guides the net up and over the lower cylinder 18 of the goal post peg 10 to give it an exit point to help it break away on heavy contact creating a safety point to have the net dislodge from the goal post peg 10, as best seen in FIG. 7. The smaller diameter upper cylinder includes a height 30 which in conjunction with the transition 22 allows a net to break away during substantial contact.

As specified above, the goal post peg 10 includes studs 34 that are received by the post plate 32. In one aspect, three studs 34 are positioned 120 degrees from each other to form an equilateral triangle pattern. The triangular pattern allows the studs 34 to be positioned into an ice surface without regard to the position of the studs 34. This is in opposition to prior art designs that may include two studs which will have various holding forces based on the position of the studs 34 relative to a direction force of a collision. For example, prior art designs having two studs may require that the studs be positioned horizontally across a goal line in order to have the net properly dislodge and move on heavy player contact. However, when the prior art two studs are put in vertically relative to the goal line, the two stud peg doesn't move as easily, causing a very dangerous issue when a player makes contact with the post/net. Another issue with the two stud design is when pressure is put onto the net/peg, the two studs may bend making them damaged and non usable.

The equilateral triangle shape of the studs 34 provides a uniform holding force which is not dependent upon the position of the studs 34 into an ice surface 15. The studs 34 create stability, leverage and a uniform holding grip into the ice surface 15. In one aspect, the studs 34 may include an upper portion 40 that is over molded with the body 12. The studs may also include a lower portion 42 that extends below or beyond the bottom ice surface 16 in a direction towards the ice surface 15. The lower portion may include a height 44 of approximately 0.875 inches as measured from a tip 46 of the studs 34 to the bottom ice surface 16. It should be realized that the dimension provided maybe considered as exemplary and may have variations above or below the exemplary dimension. The specified height 44 provides a reliable grip of the studs 34 into an ice surface 15 and also allows the studs 34 to be dislodged from the ice surface 15 upon a significant collision with a player. In one aspect, the lower portion 42 of the studs 34 may include threads 48 formed thereon. The threads 48 provide additional gripping strength into the ice surface 15. The studs 34 may be molded, welded or otherwise attached to the post plate 32 prior to a molding operation forming the body 12.

In use, the goal post peg 10 may be attached to an ice surface by pressing the studs 34 into the ice surface. The simplistic design of the goal post peg 10 allows for an end user to apply the peg into the ice with ease. The triangular stud 34 pattern simplifies applying the goal post peg 10 to the ice as one does not need to directionally position the studs 34. The rubberized design and construction of the goal post peg 10 allows for it to be light but durable while still holding its shape and rigid construction over time. The rubber material acts as an insulator to prevent localized heat transfer to the ice surface from the goal post peg 10.

Within the body 12 of the goal post peg 10 are positioned the three studs 34 to securely retain the studs 34. The three metal studs 34 are molded, welded or otherwise attached into the post plate 32. The post plate 32 provides a stop preventing the body 12 of the goal post peg 10 to get jarred up into the goal frame pipe if it is bent, rusted or split. If the post is slightly bent, the upper cylinder 24 of the goal post peg 10 allows for the peg to work its way into the bent/damaged post to work under poor goal post frame conditions.

The overall height 38, transition 22, and an upper cylinder 24 of the goal post peg 10 in conjunction with the three studded triangular design allows the goal post peg 10 to be dislodged when substantial contact is made between players and or goalie during a goal mouth collision. The overall height of 2.75 inches in conjunction with the design of the studs 34 provides a secure retention of a goal post under normal play but also allows the ability to break away when called upon during a goal mouth collision between players and or goalie. It should be realized that the dimension provided maybe considered as exemplary and may have variations above or below the exemplary dimension.

Figure 8:
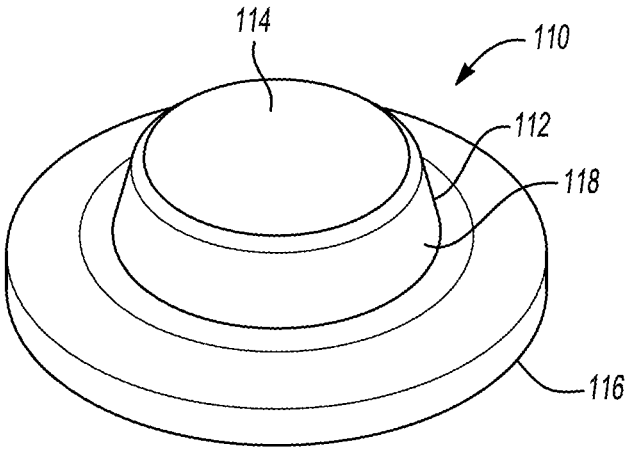
FIG. 8 is a perspective view of a goal post peg.
Figure 9:
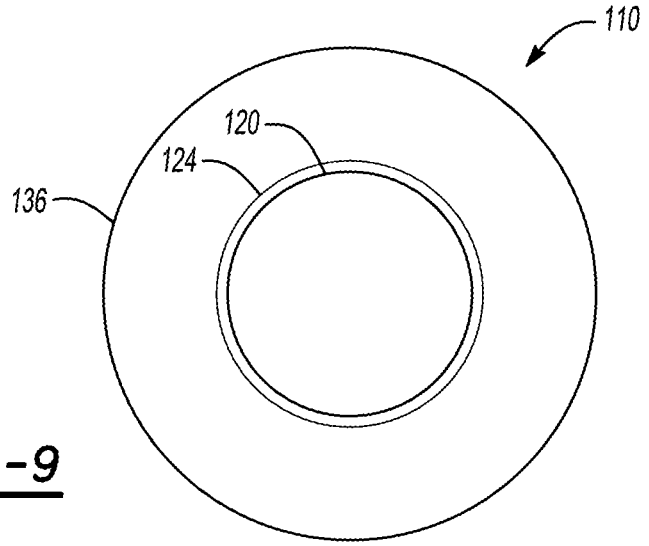
FIG. 9 is a top end view of a goal post peg.
Figure 10:
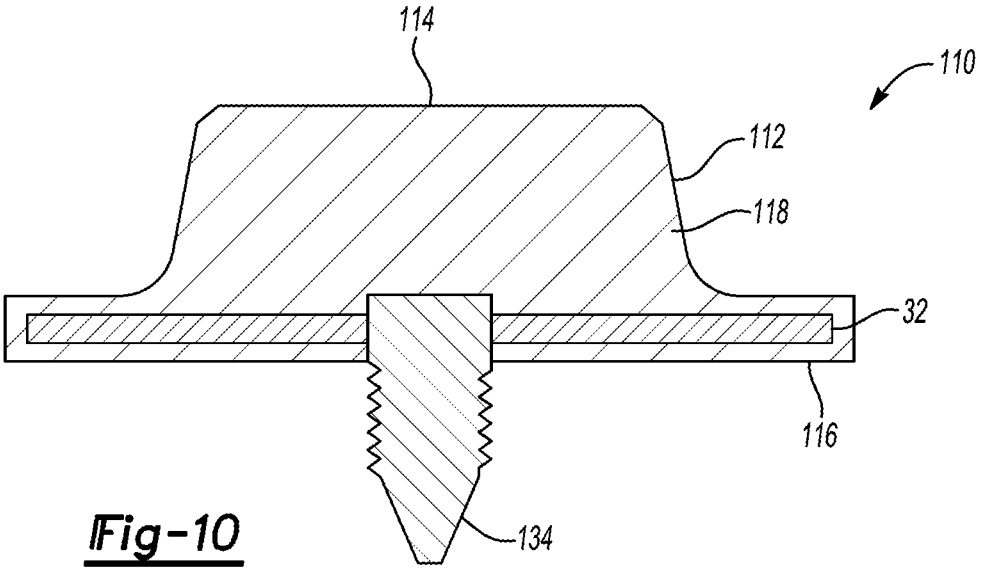
FIG. 10 is a section view of the goal post peg taken along the line B-B of FIG. 9.

Referring to FIGS. 8-10 there is shown another embodiment of a goal post peg 110. The goal post peg 110 may be utilized in mini nets that have a smaller dimension than a standard hockey net. Such mini nets may be utilized for smaller or younger players learning to skate and play hockey. The goal post peg 110 includes a body 112 that extends longitudinally from a top post surface 114 to a bottom ice surface 116. The body 112 may be formed of a rubber material such as Styrene-butadiene (SBR) rubber having a durometer of 85 that is molded to a specified shape. In one aspect, the rubber material may provide an abrasion resistant material that will withstand wear over repeated use. Additionally, the rubber material may act as an insulating material to prevent transfer of heat from the goal post peg 110 to the ice surface 115.

The body 112 includes a tapered cylinder 118 that narrows in a direction from the bottom ice surface 116 to the top post surface 114. The top post surface 114 includes a diameter 120 that is less than a size of the opening formed in the goal post 13 of the hockey net. In one aspect, the diameter 120 may be approximately 1.25 inches. A diameter 124 at a base of the tapered cylinder 118 may be approximately 1.36 inches. It should be realized that the dimension provided maybe considered as exemplary and may have variations above or below the exemplary dimension. The tapered cylinder 118 may include a height 126, as measured from the bottom ice surface 116 to the top post surface 114 of approximately 0.63 inches. It should be realized that the dimension provided maybe considered as exemplary and may have variations above or below the exemplary dimension.

A post plate 132 is attached to the body 112. The post plate 132 may include a steel plate that receives an ice stud 134 that is positioned in the ice surface 15 when in use. The post plate 132 may be over-molded with the rubber of the body 112.

The post plate 132 may include a diameter 136 that is greater than the opening in the goal post. In one aspect, the diameter 136 of the post plate 132 may be approximately 2.36 inches. It should be realized that the dimension provided maybe considered as exemplary and may have variations above or below the exemplary dimension.

The body 112 includes an overall height 138 that is selected to retain the goal post 13 on the post peg 110 and prevent the net from being dislodged by minor contact with a player such as a goalie. In one aspect the overall height 138 as measured from the top post surface 114 to the bottom ice surface 116 is approximately 0.63 inches. It should be realized that the dimension provided maybe considered as exemplary and may have variations above or below the exemplary dimension. The overall height 138 as specified may be tall enough for goalie strength and stability while moving into and on the post and short enough for breakaway purposes if heavy contact is made with the post during play. The tapered cylinder 118 guides the net up and the goal post peg 10 to give it an exit point to help it break away on heavy contact creating a safety point to have the net dislodge from the goal post peg 110.

The stud 134 creates stability, leverage and a uniform holding grip into the ice surface 15. In one aspect, the stud 134 may include an upper portion 140 that is over molded with the body 112. The stud 134 may also include a lower portion 142 that extends below the bottom ice surface 116. The lower portion 142 may include a height 144 of approximately 0.59 inches as measured from a tip 146 of the stud 134 to the bottom ice surface 116. It should be realized that the dimension provided maybe considered as exemplary and may have variations above or below the exemplary dimension. The specified height 144 provides a reliable grip of the stud 134 into an ice surface 115 and also allows the stud 134 to be dislodged from the ice surface 115 upon a significant collision with a player. In one aspect, the lower portion 142 of the stud 134 may include threads 148 formed thereon. The threads 148 provide additional gripping strength into the ice surface 15. The stud 134 may be molded, welded or otherwise attached to the post plate 132 prior to a molding operation forming the body 112.

The goal post peg 110 is designed to release upon a lower force in comparison to the goal post peg 10. The overall height 138 and dimensions of the studs 134 are smaller in the goal post peg 110 in comparison to the goal post peg 10 to allow smaller players to apply less impact force to a net and still allow the net to release or break away.

The invention claimed is:

1. An ice hockey goal post peg comprising:

a molded rubber body formed of Styrene-butadiene (SBR) rubber and extending longitudinally from a top post surface to a bottom ice surface;

a post plate disposed within the rubber body;

at least one stud attached to the post plate, the at least one stud extending beyond the bottom ice surface in a direction toward an ice surface when the goal post peg is installed wherein the molded rubber body includes a lower cylinder having a diameter less than a diameter of a goal post opening, the lower cylinder connected to an upper cylinder by a transition, the upper cylinder having a diameter less than the lower cylinder;

wherein the transition includes a chamfer connecting the lower cylinder to the upper cylinder, the transition guiding a goal post off of the goal post peg during a collision.

2. The ice hockey goal post peg of claim 1 wherein the at least one stud includes three studs positioned 120 degrees from each other to form an equilateral triangle pattern.

3. An ice hockey goal post peg comprising:

a molded rubber body extending longitudinally from a top post surface to a bottom ice surface, wherein the molded rubber body includes a lower cylinder having a diameter less than a diameter of a goal post opening, the lower cylinder connected to an upper cylinder by a transition, the upper cylinder having a diameter less than the lower cylinder and wherein the transition includes a chamfer connecting the lower cylinder to the upper cylinder, the transition guiding a goal post off of the goal post peg during a collision;

a post plate disposed within the rubber body, the post plate including a diameter greater than a diameter of an opening in a goal post;

at least one stud attached to the post plate, the at least one stud extending beyond the bottom ice surface in a direction toward an ice surface when the goal post peg is installed.

4. The ice hockey goal post peg of claim 3 wherein the molded rubber body is formed of Styrene-butadiene (SBR) rubber.

5. The ice hockey goal post peg of claim 3 wherein the body includes an overall height selected to retain a goal post on the post peg and prevent the net from being dislodged by minor contact with a player and also allow breakaway of the goal post from the goal post peg upon a heavy contact.

6. The ice hockey goal post peg of claim 3 wherein the at least one stud includes three studs positioned 120 degrees from each other to form an equilateral triangle pattern.

7. The ice hockey goal post peg of claim 3 wherein the at least one stud includes threads formed thereon.

8. The ice hockey goal post peg of claim 3 wherein the molded rubber body includes a tapered cylinder that narrows in a direction from the bottom ice surface to the top post surface.

* * * * *